US007786950B2

(12) United States Patent
Ohashi

(10) Patent No.: US 7,786,950 B2
(45) Date of Patent: Aug. 31, 2010

(54) LOOP ANTENNA AND LOOP ANTENNA MANUFACTURING METHOD

(75) Inventor: Chie Ohashi, Tokyo (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 182 days.

(21) Appl. No.: 12/203,499

(22) Filed: Sep. 3, 2008

(65) Prior Publication Data

US 2009/0058743 A1 Mar. 5, 2009

(30) Foreign Application Priority Data

Sep. 3, 2007 (JP) ..... 2007-228028

(51) Int. Cl.
*H01Q 7/00* (2006.01)
*H01Q 11/12* (2006.01)
*H01Q 21/00* (2006.01)

(52) U.S. Cl. ..... 343/870; 343/741; 343/742; 343/866; 343/867

(58) Field of Classification Search ..... 343/741, 343/742, 866, 867, 870
See application file for complete search history.

(56) References Cited

U.S. PATENT DOCUMENTS

| | | | | |
|---|---|---|---|---|
| 4,936,011 | A | 6/1990 | Berry et al. | |
| 5,655,888 | A | 8/1997 | Yumoto | |
| 5,846,098 | A | 12/1998 | Shiga et al. | |
| 6,772,505 | B1 | 8/2004 | Logan et al. | |
| 7,129,905 | B2 * | 10/2006 | Morioka | 343/866 |
| 7,345,644 | B2 * | 3/2008 | Morioka et al. | 343/866 |
| 7,573,432 | B1 * | 8/2009 | Eydelman et al. | 343/792 |

FOREIGN PATENT DOCUMENTS

| | | |
|---|---|---|
| JP | 54-49839 U | 4/1979 |
| JP | 57-128214 U | 8/1982 |
| JP | 57-186802 | 11/1982 |
| JP | 58-140612 U | 9/1983 |
| JP | 02-186606 | 7/1990 |

(Continued)

OTHER PUBLICATIONS

Japanese Office Action dated Jun. 30, 2009, for corresponding Japanese Patent Application No. 2007-228028.

*Primary Examiner*—Hoang V Nguyen
(74) *Attorney, Agent, or Firm*—Barley Snyder LLC

(57) ABSTRACT

A loop antenna is disclosed which can prevent the occurrence of variance in the loop length of the installed loop antenna element, and a method for manufacturing the loop antenna. The loop antenna comprises electrical wires constituting the antenna element and a housing that holds the electrical wires. Furthermore, the housing is formed with first guide grooves that guide the first end portions of the electrical wires and that have wall surfaces against which the tip ends on the side of the first end portions of the electrical wires abut, and second guide grooves that guide the second end portions of the electrical wires and that have wall surfaces against which the tip ends on the side of the second end portions of the electrical wires abut. Moreover, crimp parts with which the end portions of the electrical wires are connected by crimping are provided inside the respective guide grooves. In addition, a pair of contact parts that make contact with external terminals are respectively connected to the crimp parts.

4 Claims, 6 Drawing Sheets

FOREIGN PATENT DOCUMENTS

| | | |
|---|---|---|
| JP | 03-006306 U | 1/1991 |
| JP | 8-149042 | 6/1996 |
| JP | 11-251509 | 9/1999 |
| JP | 2004-013587 | 1/2004 |
| JP | 2005-191658 | 7/2005 |
| JP | 2006-191194 | 7/2006 |

* cited by examiner

PRIOR ART

PRIOR ART

LOOP ANTENNA AND LOOP ANTENNA MANUFACTURING METHOD

CROSS-REFERENCE TO RELATED APPLICATIONS

This application claims the benefit of the filing date under 35 U.S.C. §119(a)-(d) of Japanese Patent Application No.: 2007-228028, filed Sep. 3, 2007.

FIELD OF THE INVENTION

The present invention relates to a loop antenna, particularly to a loop antenna used for the radio frequency identification (RFID) transmission and reception, and to a method for manufacturing such a loop antenna.

BACKGROUND

Loop antennas are used in devices (e.g., radio tags) that exchange signals by means of radio such as RFID. Loop antennas are broadly classified into a planar type that uses a flexible printed circuit (FPC) or the like and a coil type. Typical examples in which planar-type loop antennas are used include IC cards used as tickets for means of transportation.

The requirements for IC cards include necessity to make the cards thin, necessity to possess a certain degree of flexibility, and the like. Furthermore, the IC card shown in FIG. 6 (see Japanese Patent Application Kokai No. 2004-13587), for example, has been proposed in the past to meet such requirements.

The IC card 100 shown in FIG. 6 comprises a film substrate 110 formed from a resin material, a loop antenna element 120 that is patterned on the surface of the film substrate 110, and a mounting part 130 to which the respective terminals of the loop antenna element 120 are connected. Moreover, the mounting part 130 is provided with a tuning capacitor for tuning the signal frequency of the loop antenna element 120 and an IC chip having memory.

Meanwhile, coil-type loop antennas are also used for devices which do not pose strict thickness restrictions that are required for IC cards used in cellular phones or the like having the RFID function.

Because a loop antenna requires a relatively large mounting surface area among the parts used in a device of this type for the application of this type, there are cases in which a loop antenna constructed in planar form such as that shown in FIG. 6 is hard to use. Here, if a loop antenna constructed in planar form, a problem occurs in that directionality is altered.

Furthermore, planar-type loop antennas using an FPC are expensive compared to coil-type loop antennas. Therefore, it is hard to use a planar-type loop antenna in some cases for cellular phones or the like, which have severe cost requirements. Incidentally, IC cards used as tickets for means of transportation or the like are lent by railway companies or the like in exchange with deposited money, so that the cost does not seem to be as big of an issue as in cellular phones. From such circumstances, not only planar-type loop antennas, but coil-type loop antennas are also used for IC cards used as tickets for means of transportation.

The IC card shown in FIG. 7 (see Japanese Patent Application Kokai No. H11-251509), for example, has been known in the past as such an IC card comprising a coil-type loop antenna.

The IC card 200 shown in FIG. 7 is formed by mounting a loop antenna element 220 that transmits and receives radio waves and a semiconductor chip 230 that performs information processing on a wiring board 210 having a wiring pattern formed on the front surface thereof. Furthermore, the loop antenna element 220 is electrically connected to the wiring board 210 by soldering the connecting terminals 221 of the loop antenna element 220 and the connecting lands 211 of the wiring board 210 to each other.

However, in the loop antenna of the IC card 200 shown in FIG. 7, because the loop antenna element 220 is connected to the wiring board 210 by soldering, a problem occurs in that a variance of approximately ±1 mm per each soldered portion is generated in the loop length of the loop antenna element 220 installed on the wiring board 210. The variance in the loop length of the loop antenna element 220 is especially prominent in cases where the loop antenna element 220 is a multiple loop.

Moreover, when the variance occurs in the loop length of the loop antenna element 220 installed on the wiring board 210, the resonant frequency of the loop antenna varies. Then, when the resonant frequency of the loop antenna varies, the transmission/reception distance of the loop antenna varies.

SUMMARY

The present invention was devised in view of the problems of the prior art described above. It is an object of the present invention to provide a loop antenna that can prevent the occurrence of variance in the loop length of the installed loop antenna element.

A loop antenna according to the invention has an electrical wire antenna element, an insulative housing having a first guide groove that guides the first end portion of the electrical wire and that has a wall surface against which the tip end on the side of the first end portion of the electrical wire strikes, and a second guide groove that guides the second end portion of the electrical wire and that has a wall surface against which the tip end on the side of the second end portion of the electrical wire strikes. A pair of crimp terminals each has a crimp part which is provided inside each of the guide grooves. The corresponding end portion of the electrical wire is connected thereto by crimping, and an external terminal is connected to the crimp part.

BRIEF DESCRIPTION OF THE DRAWINGS

The invention will now be described by way of example with reference to the accompanying figures of which.

DETAILED DESCRIPTION OF THE EMBODIMENTS

Next, an embodiment of the present invention will be described with reference to the figures.

The loop antenna 1 of the present invention is constructed as a loop antenna 1 that is suitable for a cellular phone having the RFID function.

Figure 1:
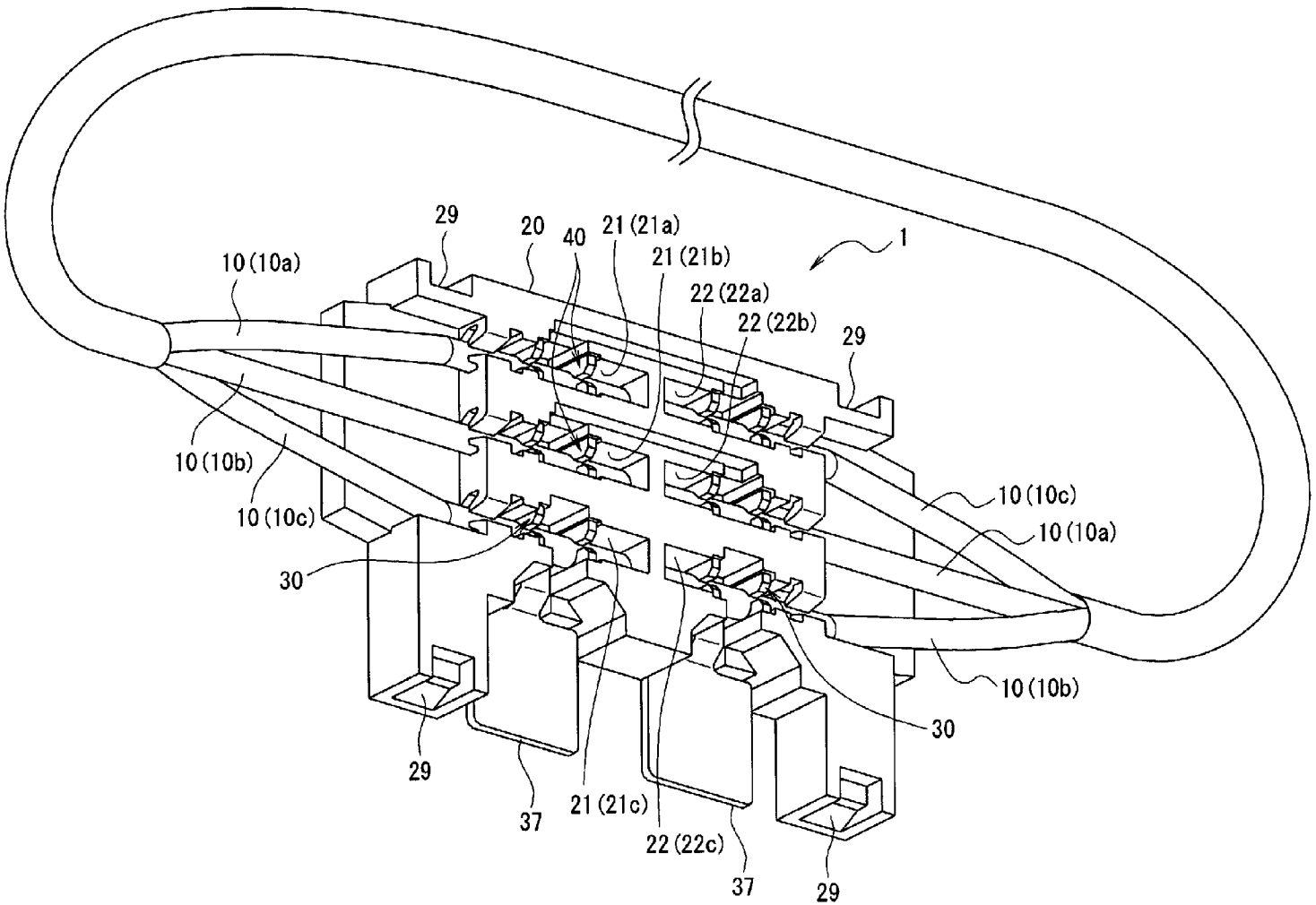
FIG. 1 is a perspective view of the loop antenna of the present invention.
Figure 2:
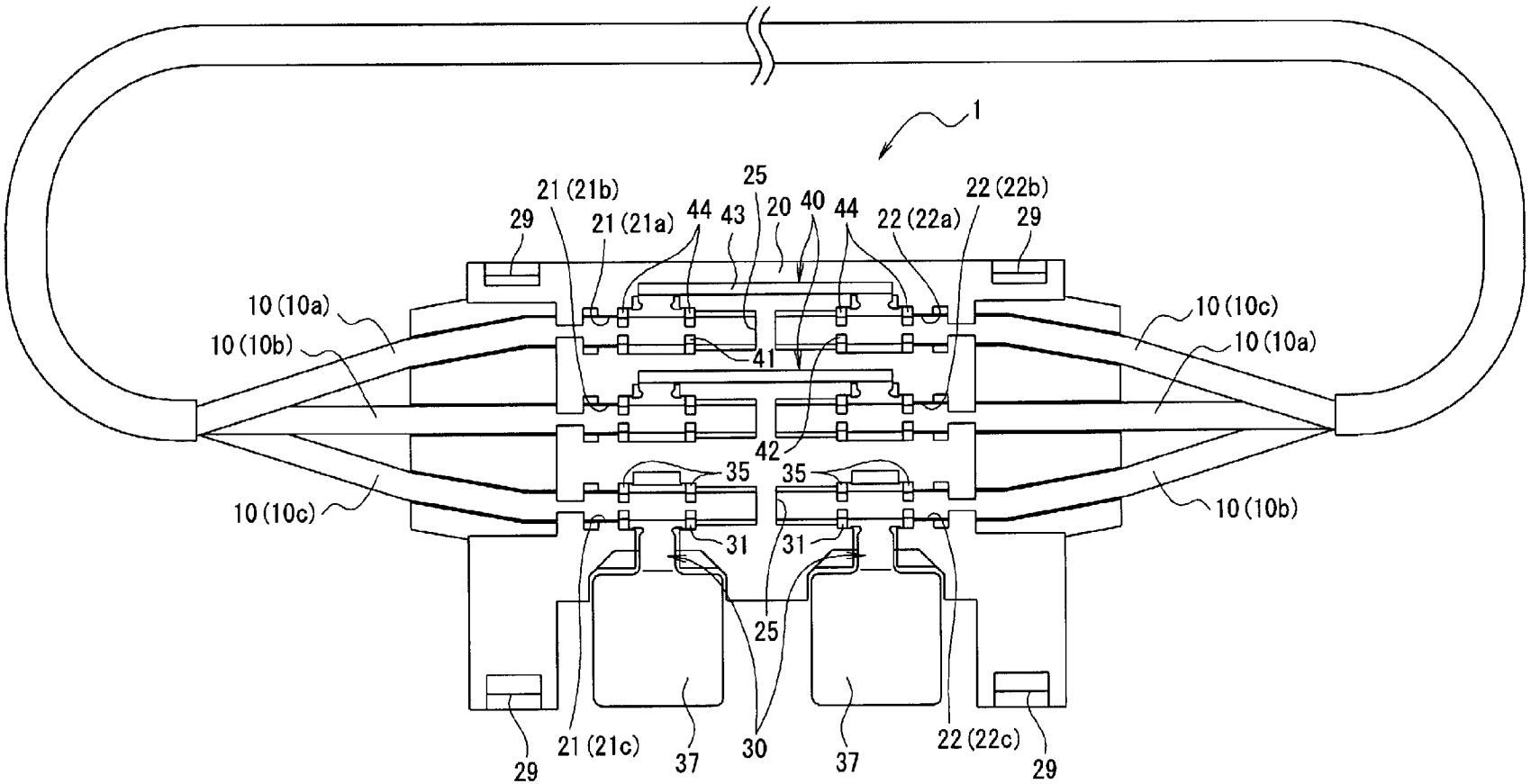
FIG. 2 is a plan view of the loop antenna shown in FIG. 1.

The loop antenna 1 shown in FIGS. 1 and 2 has three electrical wires 10 (10*a*, 10*b*, and 10*c*) forming the respective loops of a triple loop antenna, and a housing 20 that is to be mounted inside the housing (not shown in the figures) of a cellular phone or the like that has the RFID function. The loop antenna 1 further comprises two first crimp terminals 40 that mutually connect in series the three electrical wires 10, and a pair of second crimp terminals 30 to which the two ends of the three electrical wires 10 that have been mutually connected in series are respectively connected.

Copper wires or the like are used as the respective electrical wires 10. Moreover, the three electrical wires 10 are mutually connected in series in the form of a triple loop by being installed in the housing 20, thus constituting the triple loop antenna 1. Here, the respective electrical wires 10 are set in advance precisely at the same length corresponding to the frequency at which the loop antenna 1 is used. Furthermore, the three electrical wires 10 are formed as a single cable. Note that the assembly may also be such that separate electrical wires 10 are used as the three electrical wires 10.

Here, three electrical wires 10*a*, 10*b*, and 10*c* are used to form a triple loop in the loop antenna 1, but the number of electrical wires 10 that are used and the number of windings of the loop antenna 1 that is formed can be appropriately adjusted.

The housing 20 is formed as an integral unit from an insulative material. In addition, the housing 20 is provided with first guide grooves 21 that guide the first end portions of the respective electrical wires 10 and second guide grooves 22 that guide the second end portions of the respective electrical wires 10. Here, as is shown in FIG. 1, because the three electrical wires 10 are used to form the triple loop antenna in the housing 20 of the loop antenna 1, three first guide grooves 21 (21*a*, 21*b*, and 21*c*) and three second guide grooves 22 (22*a*, 22*b*, and 22*c*) are formed. Furthermore, the three first guide grooves 21 are formed on the left side of the housing 20 in a parallel fashion, while the three second guide grooves 22 are formed on the right side of the housing 20 in a parallel fashion. Moreover, the housing 20 is provided with locking parts 29 with which locking protruding parts that are provided on the above-mentioned housing mate when the loop antenna 1 is mounted on that housing.

Figure 3:
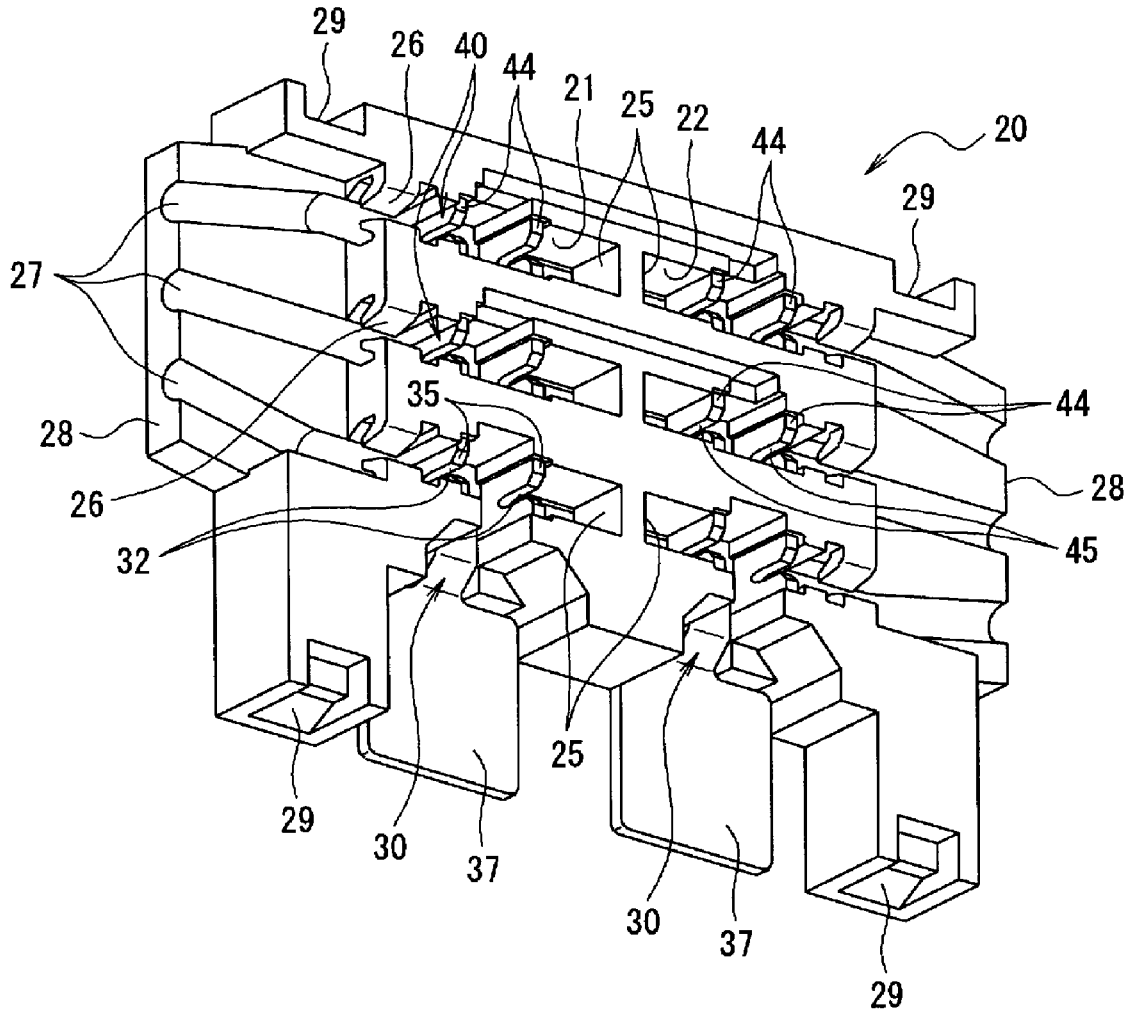
FIG. 3 is a perspective view showing the housing provided in the loop antenna shown in FIG. 1.

As is shown in FIG. 3, wall surfaces 25 against which the tip ends of the respective electrical wires 10 abut are respectively provided on the interior side of the guide grooves 21 and 22. In addition, insulation holding parts 26 which respectively hold the end portions of the individual electrical wires 10 including the insulation that are inserted into the corresponding guide grooves 21 and 22 are respectively provided on the end surfaces of the guide grooves 21 and 22 toward the front. In the end surfaces of the respective guide grooves 21 and 22, the respective insulation holding parts 26 are formed as slits which are capable of elastic displacement. Furthermore, the respective insulation holding parts 26 are capable of holding the end portions of the individual electrical wires 10 including the insulation as a when the end portions of the individual electrical wires 10 are respectively pushed into the corresponding slits formed in the end surfaces of the respective guide grooves 21 and 22. Moreover, supporting plates 28 which have supporting grooves 27 that respectively support the bottom portions of the electrical wires 10 inserted into the corresponding guide grooves 21 and 22 are provided near the front side of the guide grooves 21 and 22.

Each of the first crimp terminals 40 is formed, for example, from a copper alloy and press-fitted in the housing 20. As is shown in FIG. 2, each first crimp terminal 40 has a first crimp part 41 which is press-fitted in the corresponding first guide groove 21 and with which the corresponding electrical wire 10 that is inserted into the first guide groove 21 is connected by crimping, a second crimp part 42 which is press-fitted in the corresponding second guide groove 22 and with which the corresponding electrical wire 10 that is inserted into the second guide groove 22 is connected by crimping, and a bridge part 43 that links the first crimp part 41 and second crimp part 42.

Figure 4:
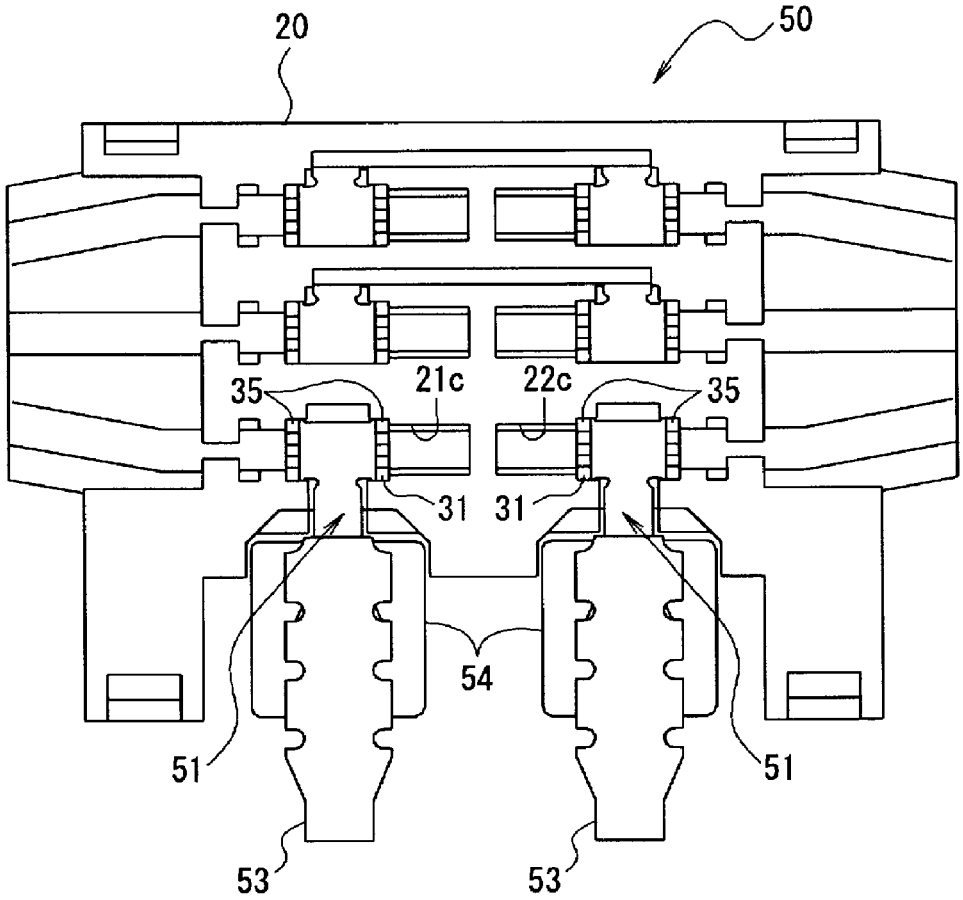
FIG. 4 is a plan view showing a modified example of the housing shown in FIG. 3.

As is shown in FIGS. 3 and 4, the respective crimp parts 41 and 42 have bottom plates (not shown in the figures) that are disposed on the bottom surfaces of the corresponding guide grooves 21 and 22 and pairs of crimp blades 44 that respectively rise from the bottom plates toward the front. As is shown in FIG. 3, each of the crimp blades 44 has a slit 45 with which the end portion of the corresponding electrical wire 10 is connected by crimping. Furthermore, the respective crimp parts 41 and 42 are capable of holding the corresponding electrical wires 10 in the electrically connected state by the simple work of pushing the end portions of the electrical wires 10 into the corresponding crimp blades 44.

In addition, in the loop antenna 1, two first crimp terminals 40 are provided in the housing 20, and one of the first crimp terminals 40 holds the first end portion of the electrical wire 10*a* inserted into the first guide groove 21*a* and the second end portion of the electrical wire 10*c* inserted into the second guide groove 22*a* in the electrically connected state. Furthermore, the other first crimp terminal 40 holds the first end portion of the electrical wire 10*b* inserted into the first guide groove 21*b* and the second end portion of the electrical wire 10*a* inserted into the second guide groove 22*b* in the electrically connected state.

Each of the second crimp terminals 30 is formed, for example, from a copper alloy and press-fitted in the housing 20. As is shown in FIG. 2, the second crimp terminals 30 respectively have crimp parts 31 which are respectively press-fitted in the corresponding guide grooves 21 and 22 and with which the corresponding electrical wires 10 inserted into the guide grooves 21 and 22 are connected by crimping. The second crimp terminals 30 also have external terminals 37 that are respectively connected to the crimp parts 31. The external terminals 37 are pushed against the contacts of a mating board, thus establishing electrical connection therebetween.

The crimp parts 31 respectively have bottom plates (not shown in the figures) that are disposed on the bottom surfaces of the corresponding guide grooves 21 and 22 and pairs of crimp blades 35 that respectively rise from the bottom plates toward the front. Each of the crimp blades 35 has a slit 32 with which the end portion of the corresponding electrical wire 10 is connected by crimping. Moreover, the respective crimp parts 31 are made capable of holding, in the electrically connected state, the corresponding electrical wires 10 that are connected by crimping by the simple work of pushing the end portions of the electrical wires 10 into the corresponding crimp blades 35.

Furthermore, in the loop antenna 1, the second crimp terminals 30 are provided in a pair in the housing 20, and one of the second crimp terminals 30 holds the first end portion of the electrical wire 10*c* inserted into the first guide groove 21*c* in the electrically connected state. Moreover, the other second crimp terminal 30 holds the second end portion of the electrical wire 10*b* inserted into the second guide groove 22*c* in the electrically connected state.

In addition, with regard to the electrical wire 10*a*, the first end portion is held by the first crimp part 41 of the first guide groove 21*a*, and the second end portion is held by the second crimp part 42 of the second guide groove 22*b*. Moreover, with regard to the electrical wire 10*b*, the first end portion is held by the first crimp part 41 of the first guide groove 21*b*, and the second end portion is held by the crimp part 31 of the second guide groove 22*c*. With regard to the electrical wire 10*c*, furthermore, the first end portion is held by the crimp part 31 of the first guide groove 21*c*, and the second end portion is held by the second crimp part 42 of the second guide groove 22*a*. As a result, the three electrical wires 10*a*, 10*b*, and 10*c* are placed in a state in which the electrical wires are mutually connected in series in the form of a triple loop. Then, the two end portions of the three electrical wires 10*a*, 10*b*, and 10*c* that have mutually been connected in series are electrically connected to the respective contact parts 37.

The loop antenna 1 that has been made in this manner is mounted inside the housing of a cellular phone or the like in a state in which the respective contact parts 37 are electrically connected to the circuit board inside that housing.

Here, in cases where the loop antenna 1 is constructed by soldering the electrical wires to the wiring board, the loop antenna is installed by bonding the wiring board to the housing. Therefore, the degree of freedom in the installation of a loop antenna in the housing is reduced.

With the loop antenna 1, on the other hand, the degree of freedom in the shape of the housing 20 is increased by using the housing 20 which is a molded product. Accordingly, it is possible to increase the degree of freedom when this loop antenna is mounted into the housing of a cellular phone or the like, such as providing the locking parts 29 in the housing 20.

With the loop antenna 1, furthermore, insulation between adjacent electrical wires 10 can be achieved in a reliable manner by the constitution that employs the housing 20.

Next, a method for assembling the loop antenna 1 will be described. When the respective electrical wires 10 are to be installed in the housing 20, the first end portions of the individual electrical wires 10 are respectively connected by crimping with the corresponding crimp parts 31 or 41 in a state in which the tip ends on the side of the first end portions of the electrical wires 10 abut the wall surfaces 25 of the corresponding first guide grooves 21. Moreover, the second end portions of the individual electrical wires 10 are respectively connected by crimping with the corresponding crimp parts 31 or 42 in a state in which the tip ends on the side of the second end portions of the electrical wires 10 abut the wall surfaces 25 of the corresponding second guide grooves 22.

In this case, the end portions of the respective electrical wires 10 are pushed into the corresponding crimp parts 31, 41, or 42 at one time by means of a crimping tool in a state in which the tip ends respectively abut the wall surfaces 25 of the corresponding guide grooves 21 or 22.

Thus, with the loop antenna 1, because the crimping connection is completed by the push-in work of the end portions of the respective electrical wires 10 disposed in specified positions all at once, it is possible to prevent the occurrence of variance in the loop length of the respective electrical wires 10 installed in the housing 20.

In addition, the loop antenna 1 makes it possible to complete the electrical connection of the respective electrical wires 10 all at once by a single operation of pushing the end portions of the individual electrical wires 10 placed in specified positions into the corresponding crimp parts 31, 41, or 42. Therefore, productivity can be increased.

Furthermore, it would also be possible to remove in advance the insulation in the end portions of the respective electrical wires 10 that are to be pushed into the corresponding crimp parts 31, 41, or 42.

Moreover, because the three electrical wires 10 are disposed as a single cable in the loop antenna 1, three electrical wires 10 that have the same length can be prepared simply by cutting one cable, so that the man hours in the manufacture of the loop antenna can be reduced. In addition, because the three electrical wires 10 are not separated, and are therefore easy to handle during mounting, the working efficiency at the time of manufacture of the loop antenna 1 can be increased.

Here, in cases where three electrical wires 10 each having a length of 200 mm are used to constitute a loop antenna for 13.56 MHz, the tolerance of each electrical wire is ±0.5 mm.

Furthermore, in cases where the respective electrical wires 10 are connected to a wiring board by soldering, a variance of approximately ±1 mm is generated in the loop length of the connected electrical wires per each end portion of the soldered electrical wires. Accordingly, in cases where three electrical wires are used to constitute a loop antenna, the variance generated in the loop length of the connected electrical wires is approximately ±6 mm at maximum.

In contrast, the loop antenna 1 makes it possible to suppress the variance in the loop length of the connected electrical wires 10 within ±0.25 to 0.3 mm per each end portion of each electrical wire 10.

Figure 5:
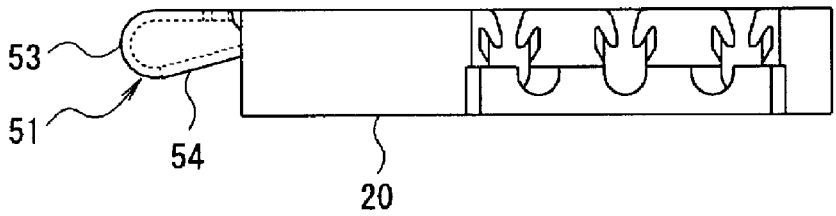
FIG. 5 is a side view of the housing shown in FIG. 4.
Figure 6:
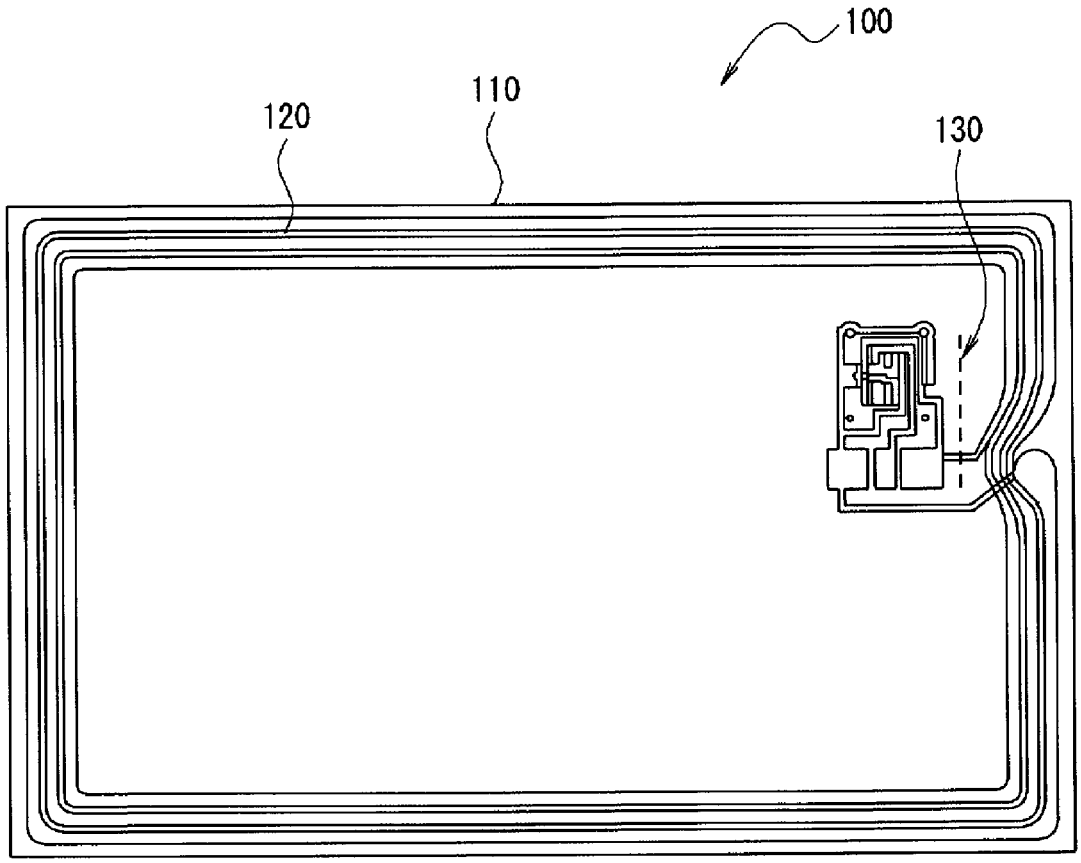
FIG. 6 is a plan view showing a conventional IC card.
Figure 7:
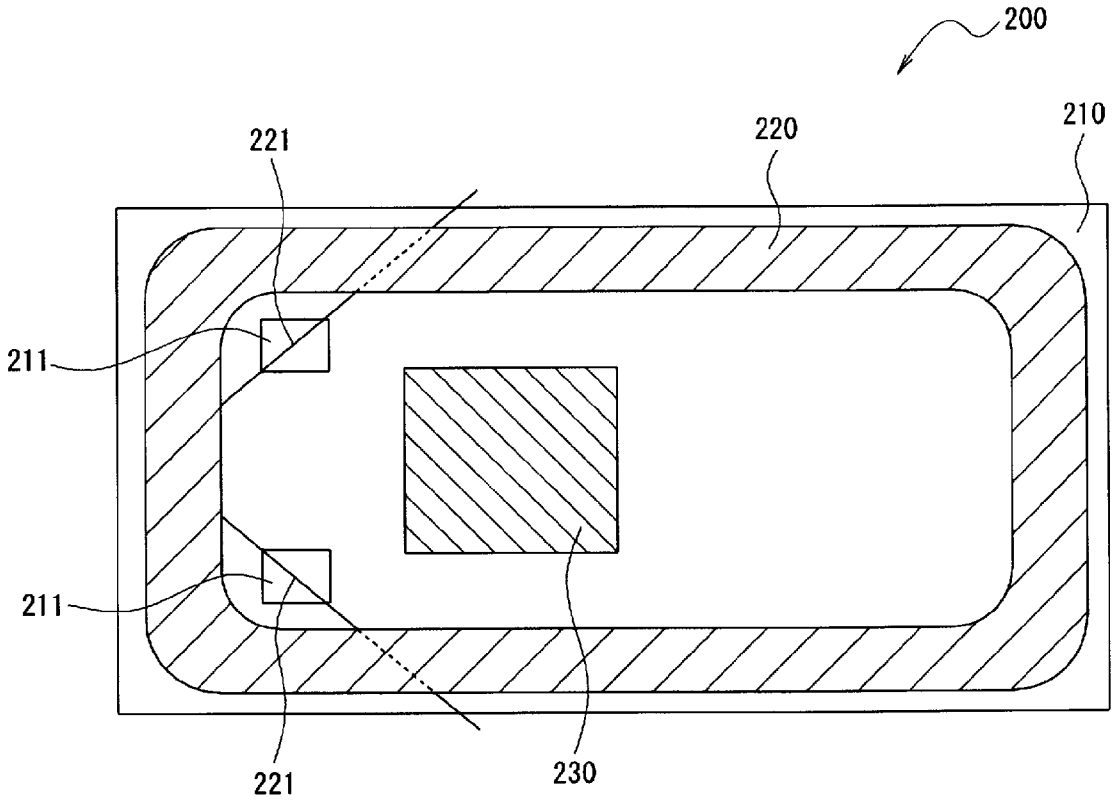
FIG. 7 is a plan view showing a conventional IC card.

Next, a modified example of the loop antenna 1 of the present embodiment will be described. FIG. 4 is a plan view showing a modified example of the housing 20 shown in FIG. 3. FIG. 5 is a side view of the housing shown in FIG. 4. The loop antenna 50 of the modified example of the loop antenna 1 comprises second crimp terminals 51 instead of the second crimp terminals 30 in the loop antenna 1.

Each of the second crimp terminals 51 is formed from a metal. As is shown in FIGS. 4 and 5, the second crimp terminals 51 respectively comprise crimp parts 31 which are respectively press-fitted in the corresponding guide grooves 21 and 22 and with which the corresponding electrical wires 10 inserted into the guide grooves 21 and 22 are connected by crimping, spring parts 53 that are each bent back in the shape of the letter U and connected to the crimp parts 31, and external terminals 54 that are connected to the spring parts 53.

Each of the spring parts 53 can absorb the displacement of the external terminal 54 connected to the spring part 53 by being bent back in the shape of the letter U.

The loop antenna 50 that has been made in this manner is mounted inside the above-mentioned housing in a state in which the respective external terminals 54 are electrically connected to the circuit board inside that housing.

In this case, the connection between the external terminals 54 and the mating circuit board may be accomplished either by a method in which the respective external terminals 54 and the contacts of the mating circuit board are caused to elastically contact with each other or by a method in which the respective external terminals 54 and the contacts of the mating circuit board are soldered to each other.

Thus, in the loop antenna 50, the displacement of the external terminals 54 can be absorbed using the constitution in which each of the second crimp terminals 51 comprises a spring part 53. Accordingly, the loop antenna 50 makes it possible to increase the degree of freedom when mounted inside the housing.

Advantageously, the plurality of electrical wires 10 have the length thereof set in advance precisely at the same length. For instance, in cases where a loop antenna for 13.56 MHz is made using three electrical wires 10 each having a length of 200 mm, the maximum tolerance of each electrical wire is ±0.5 mm. In such cases, the loop antenna 1 makes it possible to suppress the maximum tolerance of each electrical wire 10 within ±0.5 mm.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A loop antenna comprising:

an electrical wire;

an insulative housing having a first guide groove that guides the first end portion of the electrical wire and that has a wall surface against which the tip end on the side of the first end portion of the electrical wire abuts, and a second guide groove that guides the second end portion of the electrical wire and that has a wall surface against which the tip end on the side of the second end portion of the electrical wire abuts; and a pair of crimp terminals each having a crimp part receiving one end portion of the electrical wire inside each of the guide grooves and having an external terminal connected thereto.

2. A multiple loop antenna comprising:

a plurality of electrical wires;

an insulative housing having first guide grooves that are formed in a number being the same as or greater than that of the electrical wires, that respectively guide the first end portions of the individual electrical wires, and that respectively have wall surfaces against which the tip ends on the side of the first end portions of the electrical wires abut, and second guide grooves that are formed in a number being the same as or greater than that of the electrical wires, that respectively guide the second end portions of the individual electrical wires, and that respectively have wall surfaces against which the tip ends on the side of the second end portions of the electrical wires abut;

first crimp terminals each having a first crimp part which is provided inside each of the first guide grooves receiving the first end portion of the corresponding electrical wire, and a second crimp part which is provided inside each of the second guide grooves receiving the second end portion of the corresponding electrical wire, and a bridge part that links the first crimp part and the second crimp part, with the first crimp terminals mutually connecting in series the plurality of electrical wires; and a pair of second crimp terminals respectively having crimp parts which are respectively provided inside one of the first guide grooves and one of the second guide grooves and with which the two end portions of the plurality of electrical wires that have mutually been connected in series are respectively connected, and external terminals respectively connected to the crimp parts.

3. The multiple loop antenna of claim 2 wherein the plurality of electrical wires are formed as a single cable.

4. A loop antenna manufacturing method comprising the steps of:

connecting by crimping the first end portion of an electrical wire with a crimp part disposed inside a first guide groove formed in a housing in a state in which the tip end on the side of the first end portion abuts a wall surface of the first guide groove; and connecting by crimping the second end portion of the electrical wire with a crimp part disposed inside a second guide groove formed in the housing in a state in which the tip end on the side of the second end portion abuts a wall surface of the second guide groove.

* * * * *